US011333993B2

(12) United States Patent
Hiraoka et al.

(10) Patent No.: US 11,333,993 B2
(45) Date of Patent: May 17, 2022

(54) IMAGE FORMING APPARATUS HAVING EXPOSURE HEAD CONFIGURED TO EXPOSE A PHOTOCONDUCTOR DRUM

(71) Applicant: BROTHER KOGYO KABUSHIKI KAISHA, Nagoya (JP)

(72) Inventors: Junichi Hiraoka, Nagoya (JP); Hikaru Iino, Niwa-gun (JP); Junichi Yokoi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/210,096

(22) Filed: Mar. 23, 2021

(65) Prior Publication Data

US 2021/0311408 A1 Oct. 7, 2021

(30) Foreign Application Priority Data

Apr. 1, 2020 (JP) ..... JP2020-065593

(51) Int. Cl.
*G03G 15/04* (2006.01)
*G03G 21/16* (2006.01)

(52) U.S. Cl.
CPC ... *G03G 15/04054* (2013.01); *G03G 21/1619* (2013.01)

(58) Field of Classification Search
CPC ..... G03G 15/04054; G03G 21/1619; G03G 21/1842; G03G 21/1853; G03G 21/1666; G03G 21/1671
See application file for complete search history.

(56) References Cited

U.S. PATENT DOCUMENTS

2010/0054813 A1 3/2010 Tamaru et al.
2010/0232092 A1 9/2010 Sakamoto
2013/0315625 A1* 11/2013 Fujita ..... G03G 21/1666 399/125
2014/0064781 A1* 3/2014 Hashimoto ..... G03G 21/1666 399/110

FOREIGN PATENT DOCUMENTS

JP 2001-209220 A 8/2001
JP 2010-052153 A 3/2010
JP 2010-214658 A 9/2010
JP 2014-063076 A 4/2014
JP 2016-018186 A 2/2016

* cited by examiner

*Primary Examiner* — Sandra Brase
(74) *Attorney, Agent, or Firm* — Merchant & Gould P.C.

(57) ABSTRACT

An image forming apparatus is disclosed which includes a housing, one or more drum cartridges, and one or more exposure heads. Each of the one or more drum cartridges includes a photoconductor drum and is installable in the housing. Each of the one or more exposure heads is configured to expose a corresponding photoconductor drum to light, and to be movable between an exposure position fit to expose the corresponding photoconductor drum to light and a retreated position away from the corresponding photoconductor drum. The housing has a groove through which to guide installation of the drum cartridge and in which to cause an exposure head in a corresponding exposure position to be located in place in a sub scanning direction.

17 Claims, 9 Drawing Sheets

IMAGE FORMING APPARATUS HAVING EXPOSURE HEAD CONFIGURED TO EXPOSE A PHOTOCONDUCTOR DRUM

CROSS-REFERENCE TO RELATED APPLICATION(S)

This application claims priority from Japanese Patent Application No. 2020-065593 filed on Apr. 1, 2020, the disclosure of which is incorporated herein by reference in its entirety.

TECHNICAL FIELD

Apparatuses disclosed herein relate to an image forming apparatus with a drum cartridge installable in its housing.

BACKGROUND ART

Image forming apparatuses provided with removably installed drum cartridges are known in the art. On example of such an image forming apparatus comprises a housing including a frame, drum cartridges each of which is removably mounted to the frame, and exposure heads each of which is movable between an exposure position proximate to a corresponding photoconductor and a retreated position away from the corresponding photoconductor. The frame includes first rails each configured as a groove for guiding the mounting and removal of the corresponding drum cartridge, and locating parts each serving to locate an exposure head in place in relation to the corresponding photoconductor. The first rails and the locating parts are arranged in tandem in a sub scanning direction of the exposure heads.

SUMMARY

The above-described configuration with a guide for the drum cartridge and a locating part for the exposure head provided separately and aligned in the sub scanning direction would make it difficult to downsize the image forming apparatus in the sub scanning direction.

There is a need to provide a new configuration of an image forming apparatus which allows miniaturization of the apparatus in the sub scanning direction.

In one aspect, an image forming apparatus described herein comprises a housing, one or more drum cartridges, and one or more exposure heads. Each of the one or more drum cartridges includes a photoconductor drum and is installable in the housing. Each of the one or more exposure heads is configured to expose a corresponding photoconductor drum to light, and to be movable between an exposure position fit to expose the corresponding photoconductor drum to light and a retreated position away from the corresponding photoconductor drum. The housing comprises a groove through which to guide installation of a drum cartridge and in which to cause an exposure head in a corresponding exposure position to be located in place in a sub scanning direction.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

Figure 1:
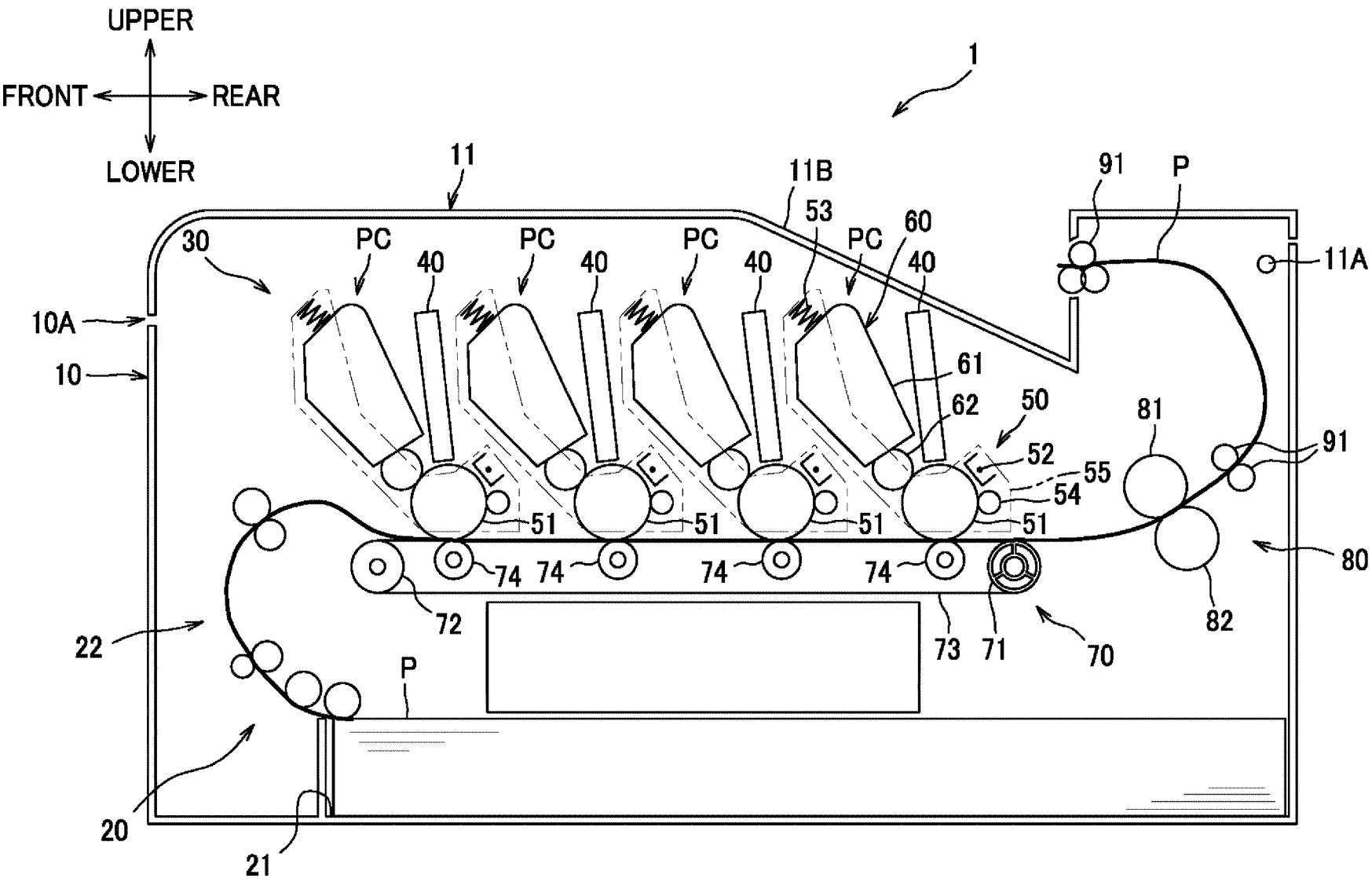
FIG. 1 is a schematic diagram of a color printer as one example of an image forming apparatus.

As shown in FIG. 1, an image forming apparatus 1 is configured as a color printer, by way of example, and mainly comprises a housing 10, a cover 11, and several components housed in the housing 10, which include a sheet feeder unit 20 and an image forming unit 30. The sheet feeder unit 20 mainly includes a sheet feed tray 21 and a sheet feed mechanism 22. The image forming unit 30 mainly includes four exposure heads 40, four process cartridges PC, a transfer unit 70, and a fixing unit 80. Each process cartridge PC includes a drum cartridge 50 and a development cartridge 60 detachably attached to the drum cartridge 50. The drum cartridge 50 mainly includes a photoconductor drum 51.

In the following description, the directions are designated as in FIG. 1 which is a schematic diagram, viewed in section from the right side, of the printer; that is, the left-hand side of the drawing sheet corresponds to the front side of the printer, the right-hand side of the drawing sheet corresponds to the rear side of the printer, the upper side (topside) of the drawing sheet corresponds to the upper side (topside) of the printer, and the lower side (bottom side) of the drawing sheet corresponds to the lower side (underside or bottom side) of the printer. The direction of a line extending rightward and leftward of the printer may be referred to as "lateral direction" and the direction of a line extending upward and/or downward may be referred to as "upward-downward direction".

The housing 10 has an opening 10A at an upper side thereof. The cover 11 is disposed over upper ends (opposite to lower ends which face on the photoconductor drums 51) of the exposure heads 40. Specifically, the cover 11 is disposed at the upper side of the housing 10 over the opening 10A. The cover 11 includes a pivot 11A provided at one end of the cover 11 lying in the front-rear direction (herein, a rear end thereof). The cover 11 is supported on the housing 10 swingably relative to the housing 10 on the pivot 11A located at an upper end of a rear side (i.e., rearward of the rearmost photoconductor drum 51) of the housing 10. The opening 10A of the housing 10 is thus openably closed by the cover 11. To be more specific, the cover 11 is swingable about an axis parallel to the lateral direction located at a position shifted to one side in the front-rear direction away from (herein, rearward of) the photoconductor drums 51. Accordingly, the cover 11 is configured to be swingable between a closed position (position shown in FIG. 1) in which the opening 10A is closed and an open position (position shown in FIG. 2) in which the opening 10A is open.

The sheet feeder unit 20 is provided in a lower space inside the housing 2. The sheet feed tray 21 is configured as a receptacle to hold and serve sheets P (e.g., of paper). The sheet feed mechanism 22 is configured to feed a sheet P held in the sheet feed tray 21, into the image forming unit 30. The sheets P in the sheet feed tray 21 are separated and fed one after another by the sheet feed mechanism 22 to the image forming unit 30.

Figure 2:
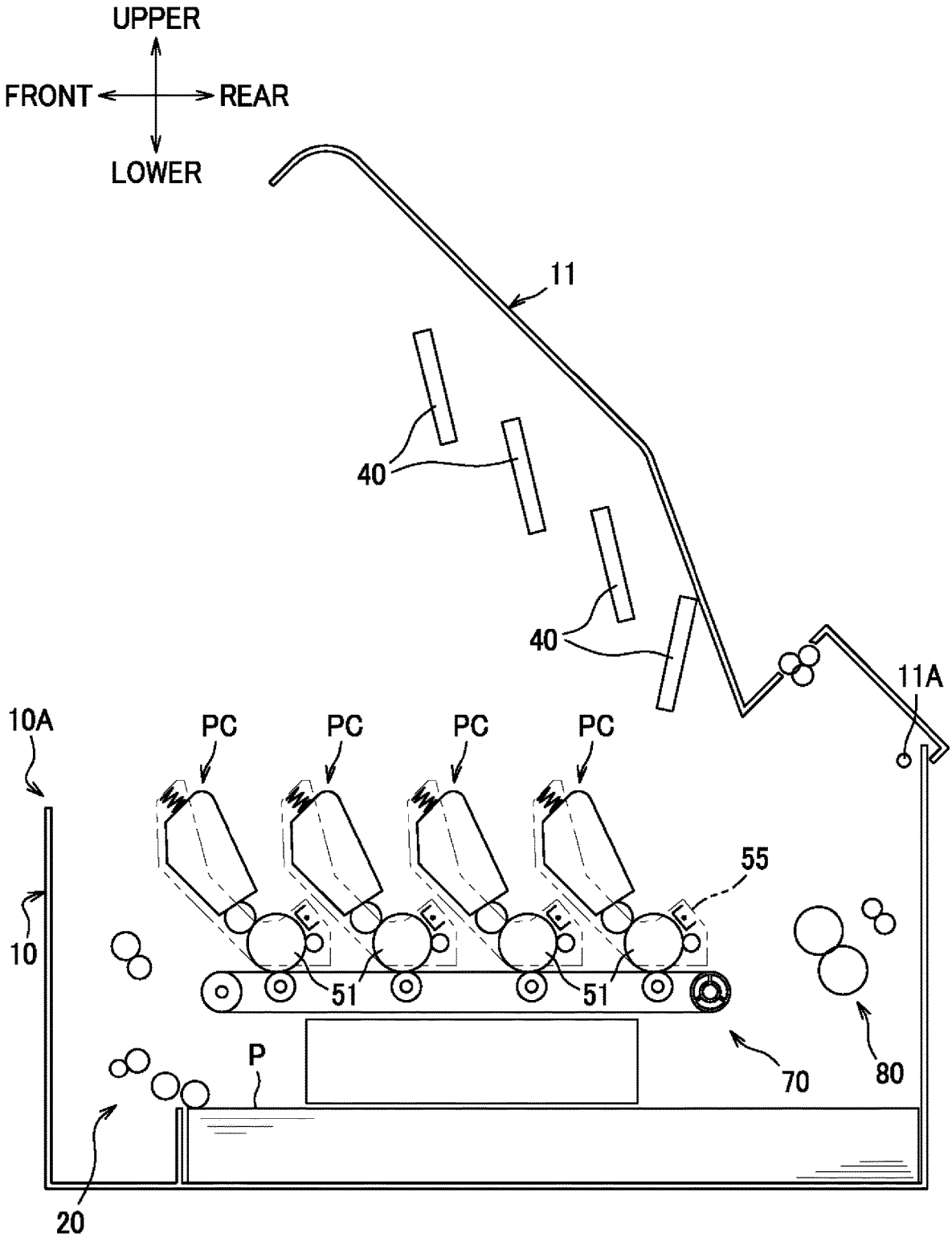
FIG. 2 shows the color printer of FIG. 1 with a cover swung open.

Each of the exposure heads 40 includes a plurality of light-emitting diodes (LEDs) provided at a lower end thereof, and an upper end thereof is supported by the cover 11, so that each exposure head 40 is suspended as shown in FIG. 2 from the cover 11 (specifically, from a holder 12 which will be described later with reference to FIGS. 3 and 4). In the state as shown in FIG. 1 where the cover 11 is in the closed position, the LEDs of each exposure head 40 face onto an upper side of the corresponding photoconductor drum 51. To be more specific, each exposure head 40 is configured to be movable between an exposure position (position shown in FIG. 1) fit to expose the corresponding photoconductor drum 51 to light and a retreated position (position shown in FIG. 2) away, farther than the exposure position, from the corresponding photoconductor drum 51. The exposure head 40 is configured to expose the surface of the corresponding photoconductor drum 51 to light by the plurality of LEDs caused to blink in accordance with image data. The structural features of the exposure head 40 will be described later in detail.

The process cartridges PC are located between the cover 11 and the sheet feed tray 21 and arranged in tandem in the front-rear direction. Each process cartridge PC is configured to be installable into the housing 10 through the opening 10A which is available when the cover 11 is open (see FIG. 2).

In each process cartridge PC, the drum cartridge 50 includes a cylindrical photoconductor drum 51, a charger 52 configured to charge the photoconductor drum 51, a compression spring 53 by which the development cartridge 60 detachably attached to the drum cartridge 50 is biased toward the photoconductor drum 51, a cleaning roller 54, and a drum frame 55 by which the photoconductor drum 51 and other components are supported.

The cleaning roller 54 is configured to remove foreign matter such as toner left on the photoconductor drum 51. The cleaning roller 54 is rotatable in contact with the photoconductor drum 51.

The development cartridge 60 mainly includes a toner container 61 and a development roller 62. The toner container 61 is configured to hold toner. The development roller 62 is configured to supply toner in the toner container 61 to the photoconductor drum 51.

The transfer unit 70 is disposed between the sheet feed tray 21 and the process cartridges PC. The transfer unit 70 mainly includes a drive roller 71, a follower roller 72, a conveyor belt 73, and four transfer rollers 74. The conveyor belt 73 is an endless belt looped around and run between the drive roller 71 and the follower roller 72. The conveyor belt 73 has an outside surface in contact with each photoconductor drum 51. The transfer rollers 74 are located inside the conveyor belt 73, and so arranged that the conveyor belt 73 is held between each transfer roller 74 and the corresponding photoconductor drum 51.

The fixing unit 80 is disposed rearward of the process cartridges PC and the transfer unit 70. The fixing unit 80 mainly includes a heating roller 81, and a pressure roller 82. The pressure roller 82 is located opposite to the heating roller 81, and configured to press the heating roller 81.

In the image forming unit 30 as described above, the surface of each photoconductor drum 51 is uniformly charged by the corresponding charger 52, and then exposed to light by the corresponding exposure head 40, so that an electrostatic latent image formulated based on image data is formed on the surface of the photoconductor drum 51. Thereafter, toner is supplied from the development roller 62 to the surface of the photoconductor drum 51, and visualizes the electrostatic latent image, so that a toner image is formed on the surface of the photoconductor drum 51.

Toner images formed on the surface of the photoconductor drums 51 are transferred by the transfer rollers 74 sequentially and superposed onto a sheet P conveyed on the conveyor belt 73. The sheet P on which the toner images are transferred is conveyed through between the heating roller 81 and the pressure roller 82, so that the toner images are thermally fixed thereon. Subsequently, the sheet P is ejected out of the housing 10 by conveyor rollers 91, and placed on a sheet output tray 11B formed on a top surface of the cover 11.

Next, a detailed description will be given of the drum cartridge 50, the exposure head 40 and associated structural features with reference to FIGS. 3 and 4.

Figure 3:
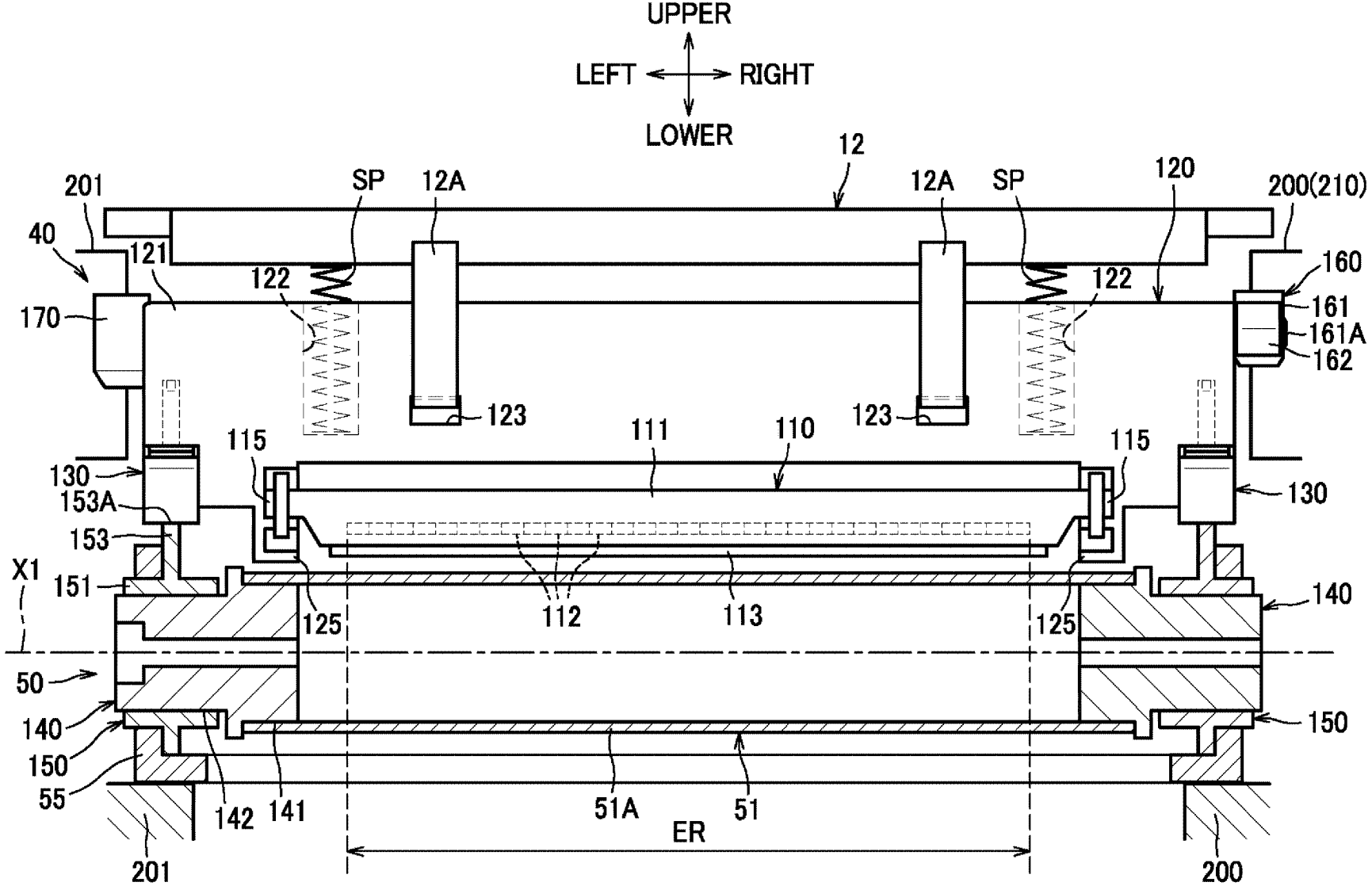
FIG. 3 shows an exposure head in an exposure position, and a drum cartridge.

In the illustrated image forming apparatus 1, the rotation axis X1 of the photoconductor drum 51 coincides with the axis of its cylindrical surface shape and lies in the lateral direction as shown in FIG. 3. In the following description, the direction parallel to the rotation axis X1, i.e., the lateral direction, will be referred to simply as "axial direction" as the case may be.

The photoconductor drum 51 includes a cylindrical base pipe 51A and two fit-in members 140. The base pipe 51A is made of metal or other electrically conductive material. A photoconductive layer (not shown) is formed on an outer cylindrical surface of the base pipe 51A. The left and right fit-in members 140 are fitted onto the left and right ends of the base pipe 51A, respectively. The fit-in members 140 are made of plastic. Each fit-in member 140 includes an inside portion 141 and an outside portion 142 formed integrally in one piece. The inside portion 141 is a portion located inside the base pipe 51A (inside relative to the laterally outer end of the base pipe 51A) when the fit-in member 140 is fitted to the base pipe 51A, with an inner cylindrical surface of the base pipe 51A being fitted tightly on an outer peripheral surface of the inside portion 141. The outside portion 142 is an exposed portion protruding from the laterally outer end of the base pipe 51A outward in the axial direction (i.e., laterally outward) when the fit-in member 140 is fitted to the base pipe 51A. The fit-in member 140 is fitted tightly to the base pipe 51A, and thus is rotatable together with the base pipe 51A.

The photoconductor drum 51 is rotatably supported with its two ends held by bearing members 150. Each of the bearing members 150 is supported on the drum frame 55. In this way, the photoconductor drum 51 is supported by the drum frame 55 rotatably about the rotation axis X1 of the photoconductor drum 51.

Each bearing member 150 is configured as a member by which an outer peripheral surface of the outside portion 142 of the corresponding fit-in member 140 is rotatably supported. To be more specific, the bearing member 150 is configured as a sliding bearing made of plastic. The bearing member 150 mainly includes a cylindrical bearing portion 151 by which the fit-in member 140 is rotatably supported, and a projection 153 which extends from the bearing portion 151 toward the exposure head 40. The projection 153 has at an end thereof a contact surface 153A with which the exposure head 40 is contactable.

Figure 4:
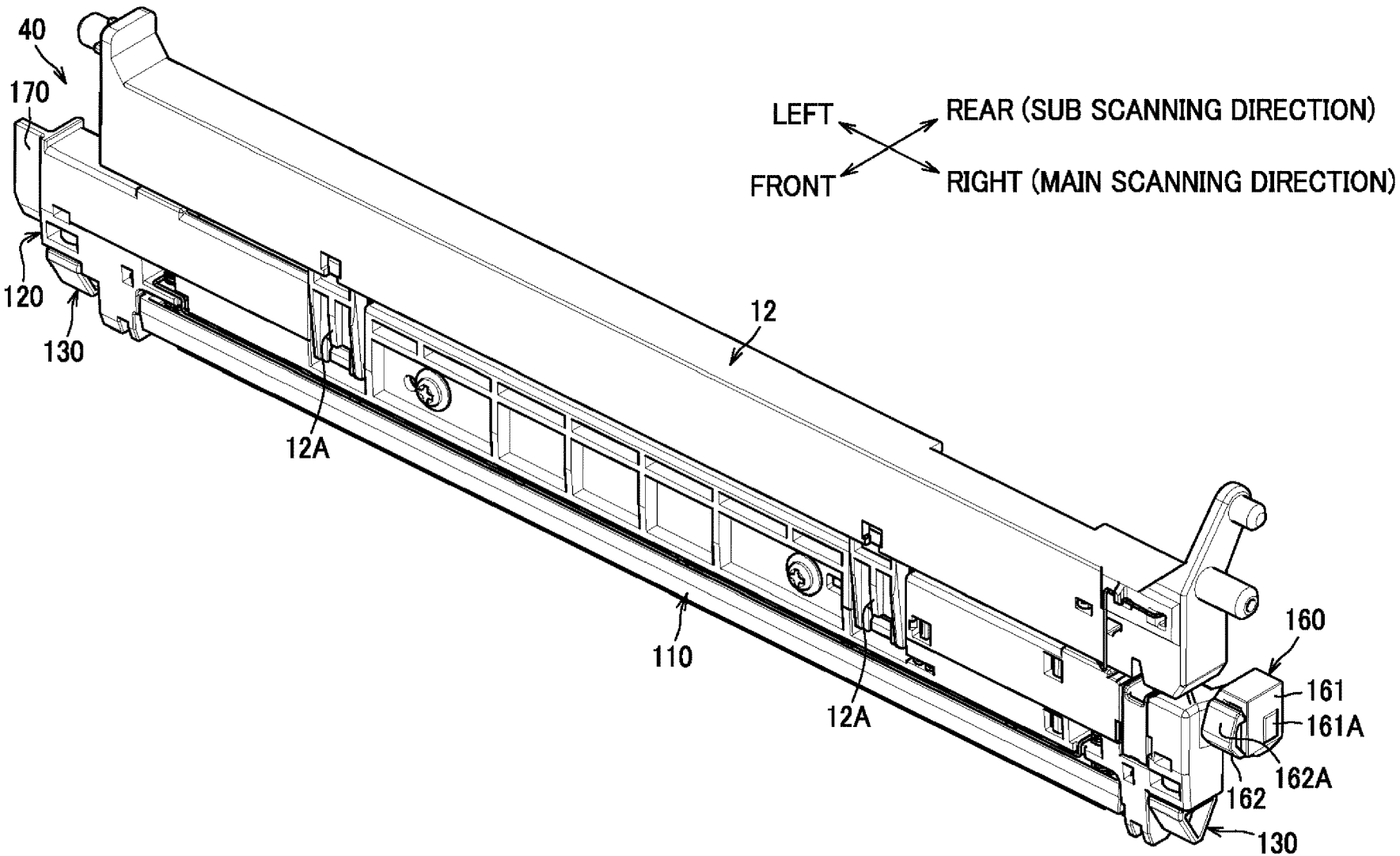
FIG. 4 is a perspective view of the exposure head.

As shown in FIGS. 3 and 4, the exposure head 40 includes a first frame 110, a second frame 120, a space adjuster 130, a pressing member 160, and a rib 170.

The contact surface 153A of the projection 153 contacts the space adjuster 130 of the exposure head 40 to thereby locate the exposure head 40 (more specifically, a lens array 113 which will be described below) at a predetermined distance from the surface of the photoconductor drum 51 in the direction of an optical axis. The space adjuster 130 is disposed between the second frame 120 and the drum cartridge 50 (more specifically, the bearing member 150).

The first frame 110 and the second frame 120 are made of plastic.

The first frame 110 includes a base 111 and two projections 115 formed integrally in one piece. The base 111 has approximately a shape of a rectangular parallelepiped elongate in the lateral direction. The projections 115 protrude from left and right ends of the base 111 to the left and to the right, respectively (i.e., laterally outward). The base 111 is made of plastic.

In the base 111, a plurality of LED arrays 112 are provided. The plurality of LED arrays 112 are arranged in the axial direction. The base 111 has an opening at its bottom, and the lens array 113 is provided at the opening. The lens array 113 is an example of an optics that forms images from light emitted by the LED arrays 112 on the surface of the photoconductor drum 51.

Each of the LED arrays 112 is a semiconductor device comprising a plurality of light-emitting elements (light-emitting diodes or LEDs) arranged in the axial direction. The LED arrays 112 are configured such that the light-emitting elements are caused to blink sequentially in a direction parallel to the rotation axis X1 to scan the surface of the photoconductor drum 51 with light for exposure.

The lens array 113 has an undersurface located opposite to the surface of the photoconductor drum 51 and configured as a light-exit surface from which light is emitted.

The direction in which the surface of the photoconductor drum 51 is scanned with light emitted from the plurality of LED arrays 112 arranged in the axial direction is herein referred to as a main scanning direction. The direction parallel to the optical axis coincides with a direction of light emitted from the LED arrays 112. The direction perpendicular to the optical axis and to the main scanning direction is herein referred to as a sub scanning direction. In the illustrated image forming apparatus 1, the sub scanning direction coincides substantially with a front-rear direction, that is, a direction of tandem arrangement of the process cartridges PC.

The second frame 120 is configured to support the first frame 110, and is suspended from and supported by the holder 12 which in turn is rotatably supported by the cover 11. The holder 12 is made of plastic. The second frame 120 includes a base 121 and two protrusions 125 formed integrally in one piece. The base 121 has approximately a shape of a rectangular parallelepiped elongate in the lateral direction.

The base 121 comprises two first recesses 122 and two holes 123. The holes 123 are arranged left and right, symmetrically with respect to the center of the base 121, and distanced from each other in the lateral direction. Each of the holes 123 is a through hole that pierces through the base 121 in the front-rear direction and connects front and rear sides of the base 121.

The holder 12 includes two hooks 12A with which the base 121 is suspended. The hooks 12A are located in positions corresponding to the holes 123. The end of each hook 12A protrudes inward in the front-rear direction, and engages in a corresponding hole 123. The holder 12 retains the base 121 with some play allowed in the front-rear direction and in the upward-downward direction. Accordingly, the exposure head 40 is supported via the holder 12, movably in the front-rear direction and in the upward-downward direction relative to the cover 11.

Each of the first recesses 122 is a recess that opens toward the holder 12. The left and right first recesses 122 are arranged at laterally outer sides of the two holes 123, i.e., at the left side of the left hole 123 and at the right side of the right hole 123, respectively. A compression coil spring SP is provided between a bottom surface of each first recess 122 and the holder 12. The compression coil springs SP serve as a biasing member that biases the exposure head 40 toward the photoconductor drum 51.

The protrusions 125 are portions that support both ends (i.e., the projections 115 at the left and right ends of the base 111 elongate in the axial direction) of the first frame 110. The protrusions 125 protrude from the undersurface of the base 121 toward the photoconductor drum 51. To be more specific, the protrusions 125 protrude down beyond the position of the lens array 113 in a direction parallel to the optical axis. With the projections 115 attached to the protrusions 125, the first frame 110 is supported by the second frame 120.

As shown in FIG. 4, the pressing member 160 is provided at one side (one of two sides facing outward in a direction parallel to the rotation axis X1) of the second frame 120. In the illustrated image forming apparatus 1, the pressing member 160 is provided at the right side of the second frame 120. The pressing member 160 is configured to cause the exposure head 40 in the exposure position to be pressed in a direction parallel to the sub scanning direction. The pressing member 160 includes a base 161, a pressing part 162, and a spring 163 (see FIG. 8). The pressing member 160 is, as will be described later, configured to be received in a groove 210 or a groove 210B (see FIG. 6) of the right side frame 200 of the housing 10 and used to cause the exposure head 40 in the exposure position to be located in place relative to the housing 10.

The base 161 has a shape of a box with the spring 163 located inside. The base 161 includes a protuberance 161A in the right side surface (at a side facing outward in a direction parallel to the rotation axis X1) thereof.

The pressing part 162 is disposed at a front side of the base 161. The pressing part 162 is supported by the base 161, movably relative to the base 161 in the sub scanning direction. The pressing part 162 has a sliding surface 162A curving outward or bulging in a direction parallel to the sub scanning direction (i.e., frontward) as apparent when viewed from a direction parallel to the main scanning direction or the axial direction (i.e., from the right side). The pressing part 162 is made of plastic, such as polyacetals (e.g., polyoxymethylene or POM), having an excellent slipperiness or an easy-to-slide property. The pressing part 162 is biased in a direction parallel to the sub scanning direction (i.e., frontward) by the spring 163 inside the base 161.

The rib 170 is provided at the other side (one of two sides facing outward in a direction parallel to the rotation axis X1) of the second frame 120. In the illustrated image forming apparatus 1, the rib 170 is provided at the left side (opposite to the side at which the pressing member 160 is provided) of the second frame 120. The rib 170 is configured to be received in a groove of the left side frame 201 (see FIG. 3) of the housing 10 and used to cause the exposure head 40 in the exposure position to be located in place relative to the housing 10. The rib 170 has a shape of a plate having longer sides oriented in a direction parallel to the optical axis.

Figure 5A:
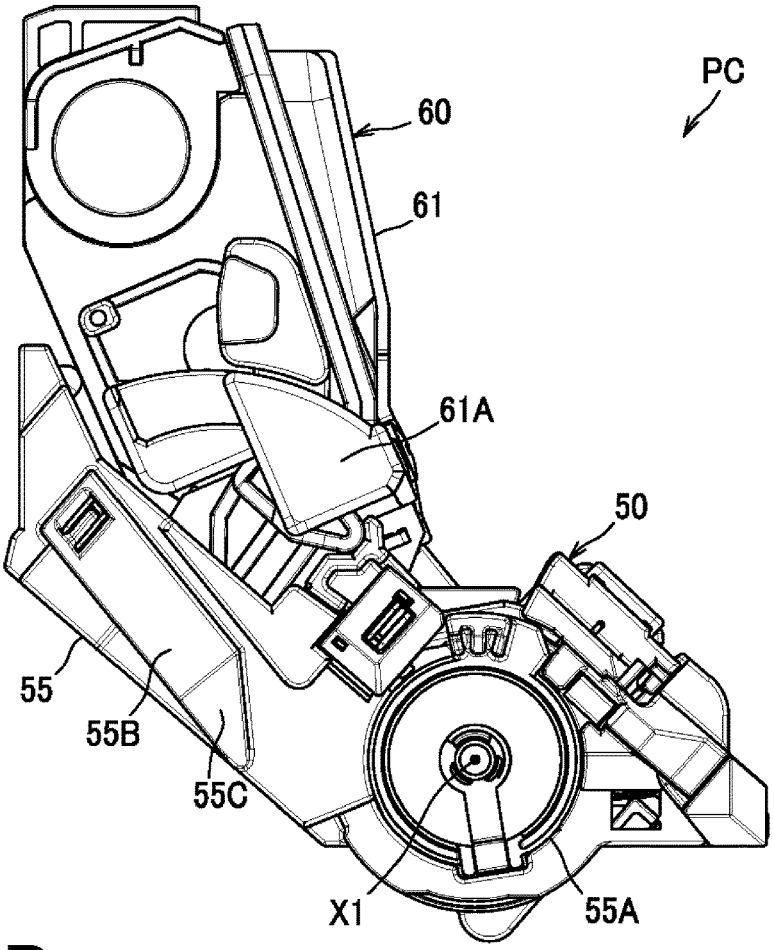
FIG. 5A is a side elevation of a process cartridge.
Figure 5B:
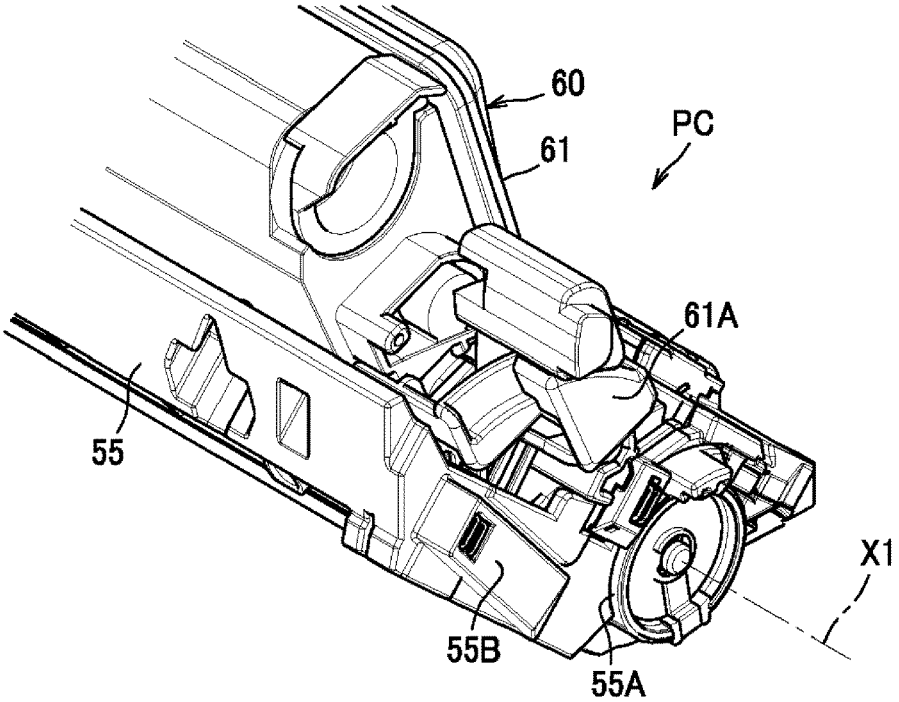
FIG. 5B is a perspective view of a side portion of the process cartridge.

As shown in FIGS. 5A and 5B, the drum frame 55 includes an arcuate portion 55A and a protrusion 55B.

The arcuate portion 55A is an arc-shaped portion extending along a circumference of a circle of which a center coincides with the rotation axis X1. The arcuate portion 55A is provided at each of the left and right sides (two sides facing outward in directions parallel to the axial direction) of the drum frame 55.

The protrusion 55B is configured to be engageable in and slidable through the groove 210 or the groove 210C (see FIG. 6) of the housing 10 to allow the drum cartridge 50 to be guided for installation in the housing 10. The protrusion 55B protrudes from one side (one of two sides facing outward in a direction parallel to the rotation axis X1; the right side, in the illustrated example) of the drum frame 50 outward beyond an end of the photoconductor drum 51 in a direction parallel to the rotation axis X1. The protrusion 55B may have a cross-sectional shape elongate in a direction of installation of the drum cartridge 50. To be more specific, the protrusion 55B illustrated herein has a shape of a plate having longer side edges oriented in a direction of installation of the drum cartridge 50, and includes an end portion 55C with its sides of the plate shape tapered toward a leading edge in the direction of installation. Although a detailed description will be given later, the drum cartridge 50 installed in the housing 10 is located in place by contact of a portion of the protrusion 55B with the groove. The position of the drum cartridge 50 installed in the housing 10 will be referred to as "installed unit position" where appropriate.

The development cartridge 60 includes a protrusion 61A provided at one side (right side) facing outward in a direction parallel to the rotation axis X1. The protrusion 61A protrudes from the right side of the development cartridge 60 outward in a direction parallel to the rotation axis X1 (i.e., rightward). When the process cartridge PC with the development cartridge 60 attached to the drum cartridge 50 therein is installed into the housing 10, the protrusion 61A passes through the groove 220 of the housing 10.

Figure 6:
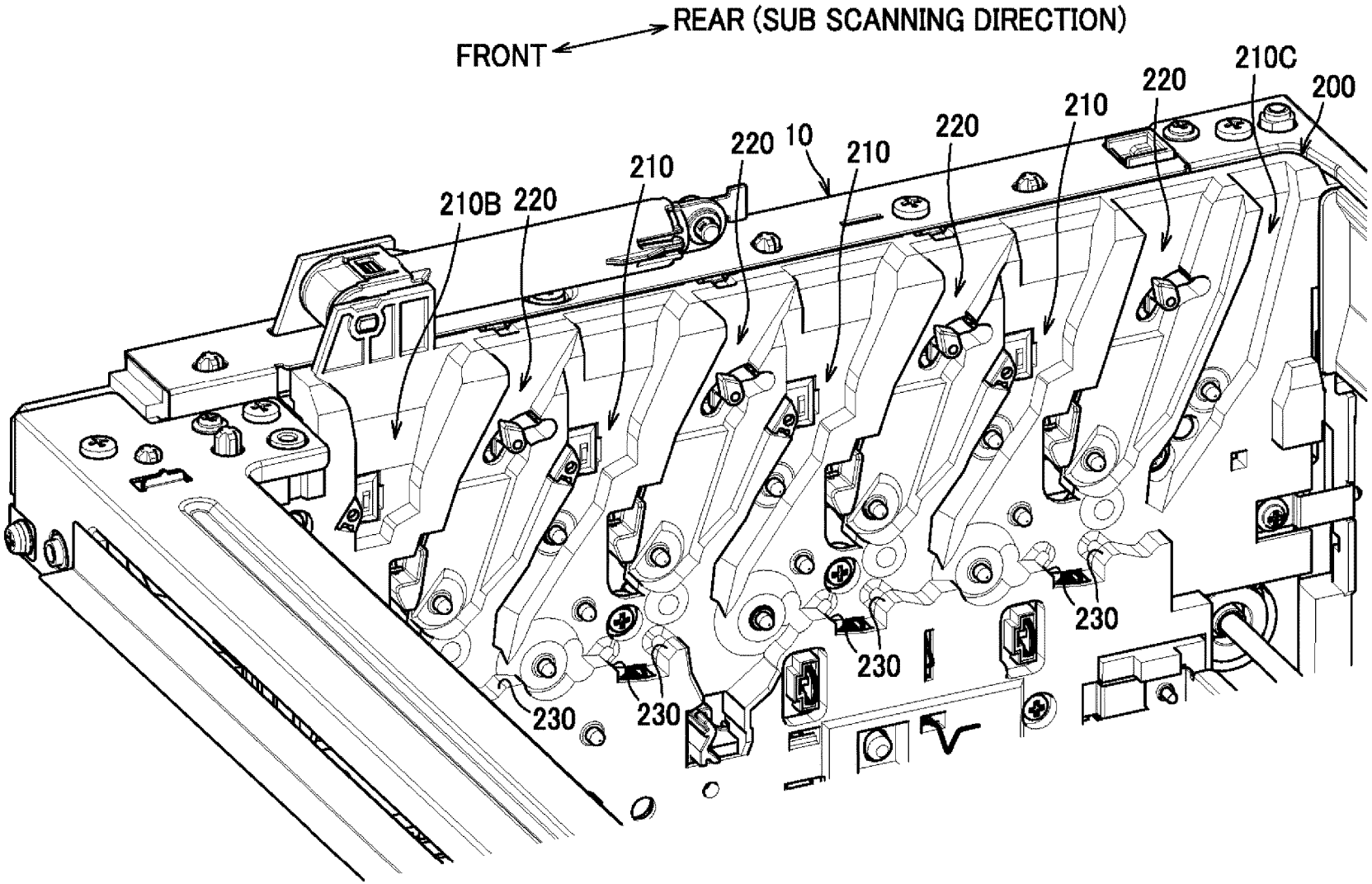
FIG. 6 is a perspective view showing an interior configuration of a side frame of a housing.
Figure 7:
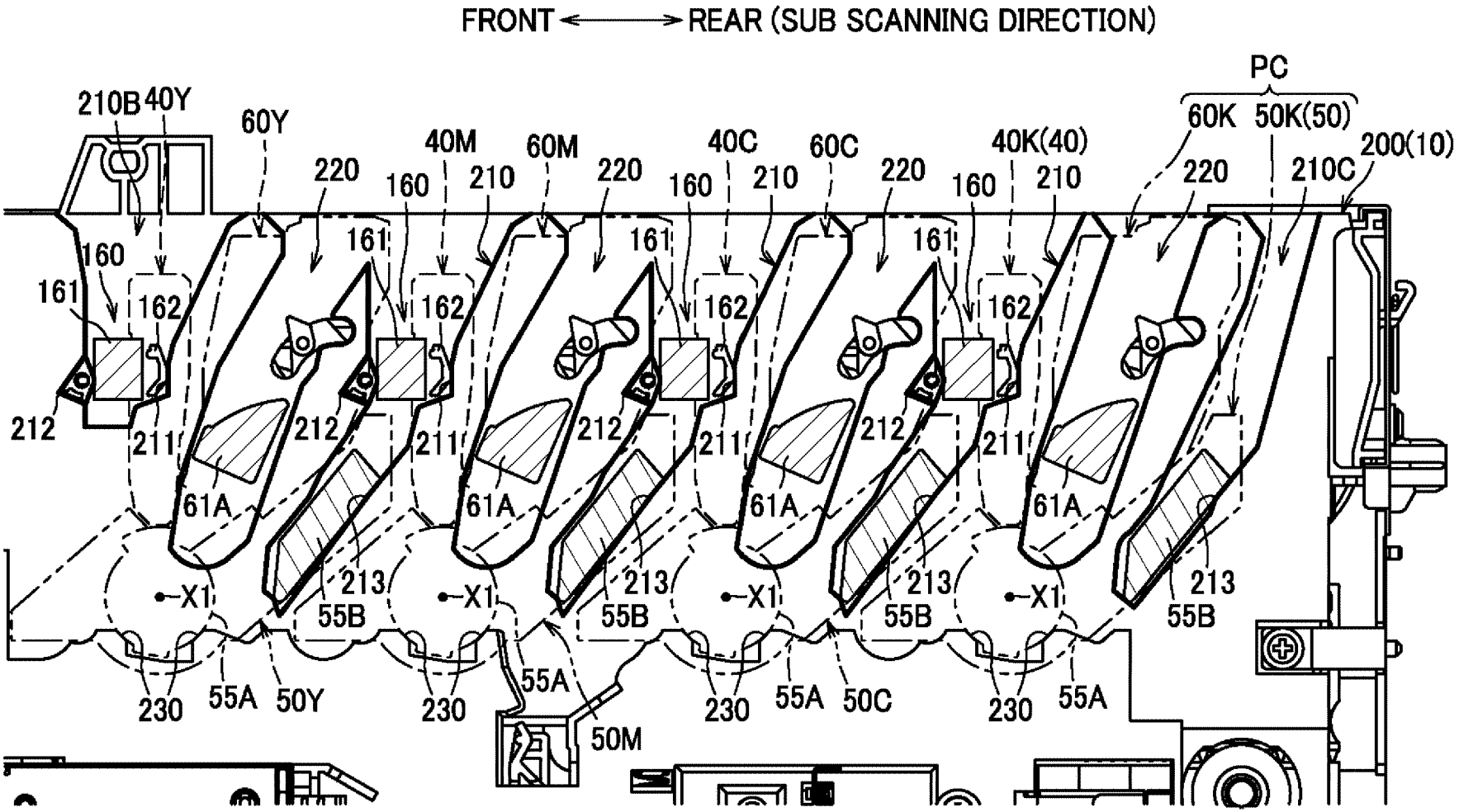
FIG. 7 is a diagram for explaining the state in which process cartridges are installed in the housing, the cover is closed, and exposure heads are located in their exposure positions.

As shown in FIG. 6, the right side frame 200 of the housing 10 includes a plurality of drum locating portions 230; for each process cartridge PC, two drum locating portions 230 are provided. Of two drum locating portions 230 located below the rotation axis X1 of the drum cartridge 50 as installed, as seen in FIG. 7, one is in a position shifted from the position of the rotation axis X1 to the front and the other is in a position shifted from the position of the rotation axis X1 to the rear. In a state where the drum cartridge 50 is installed in the housing 10, the arcuate portion 55A of the drum frame 55 is in contact with the drum locating portions 230 of the housing 10 whereby the drum cartridge 50 is located in place. In particular, the rotation axis X1 of the photoconductor drum 51 supported by the drum cartridge 50 is properly positioned by contact of the arcuate portion 55A with the two drum locating portions 230 in the housing 10.

There are four drum cartridges 50 arranged in tandem in the sub scanning direction (in the front-rear direction). To be more specific, the drum cartridges 50 include a drum cartridge 50K for black, a drum cartridge 50C for cyan, a drum cartridge 50M for magenta, and a drum cartridge 50Y for yellow, which are arranged in tandem from the rear to the front in this order. Each of the drum cartridges 50K, 50C, 50M, 50Y for black, cyan, magenta and yellow includes a photoconductor drum 51. The drum cartridge 50K for black is an example of a first drum cartridge. The drum cartridge 50C for cyan is an example of a second drum cartridge. The photoconductor drum 51 included in the drum cartridge 50K is an example of a first photoconductor drum. The photoconductor drum 51 included in the drum cartridge 50C is an example of a second photoconductor drum.

Similarly, four exposure heads 40 are arranged in tandem in the sub scanning direction, which include an exposure head 40K for exposing the photoconductor drum 51 in the drum cartridge 50K for black to light, an exposure head 40C for exposing the photoconductor drum 51 in the drum cartridge 50C for cyan to light, an exposure head 40M for exposing the photoconductor drum 51 in the drum cartridge 50M for magenta to light, and an exposure head 40Y for exposing the photoconductor drum 51 in the drum cartridge 50Y for yellow to light. The exposure head 40K for exposing the photoconductor drum 51 (first photoconductor drum) in the drum cartridge 50K (first drum cartridge) to light is an example of a first exposure head which is movable between a first drum exposure position fit to expose the first photoconductor drum to light and a first retreated position away from the first photoconductor drum. The exposure head 40C for exposing the photoconductor drum 51 (second photoconductor drum) in the drum cartridge 50C (second drum cartridge) to light is an example of a second exposure head which is movable between a second drum exposure position fit to expose the second photoconductor drum to light and a second retreated position away from the second photoconductor drum.

The housing 10 comprises three grooves 210 and one groove 210C, each serving to guide installation of the corresponding drum cartridge 50.

Each groove 210, 210C is formed in an inside surface of the side frame 200, and configured to extend from an upper edge of the side frame 200 downward.

Amongst the four grooves 210, 210C, the groove 210C is located in the rearmost position. The groove 210C is an example of a first groove through which to guide installation of the drum cartridge 50K that is the first drum cartridge.

The three grooves 210 having the same shape are arranged frontward of the groove 210C in tandem in the sub scanning direction. Amongst the three grooves 210, a rearmost groove 210 is an example of a second groove which is located adjacent to the groove 210C and through which to guide installation of the drum cartridge 50C (second drum cartridge) for cyan.

The three grooves 210 are each configured as a groove through which to guide installation of a corresponding drum cartridge 50 and in which to cause a corresponding exposure head 40 in the exposure position to be located in place in the sub scanning direction.

Each of the grooves 210 and the groove 210C is configured to allow the protrusion 55B of the corresponding drum cartridge 50 to be engaged slidably therein and guided therethrough. Each of the groove 210C and the grooves 210 has a frame locating surface 213 with which an upper portion of the protrusion 55B of the drum cartridge 50 in its installed unit position is in contact. The frame locating surface 213 is part of a rear side surface of each groove 210, 210C.

The housing 10 further comprises a groove 210B configured as a groove in which to cause the frontmost exposure head 40Y in the exposure position to be located in place in the sub scanning direction.

Figure 8:
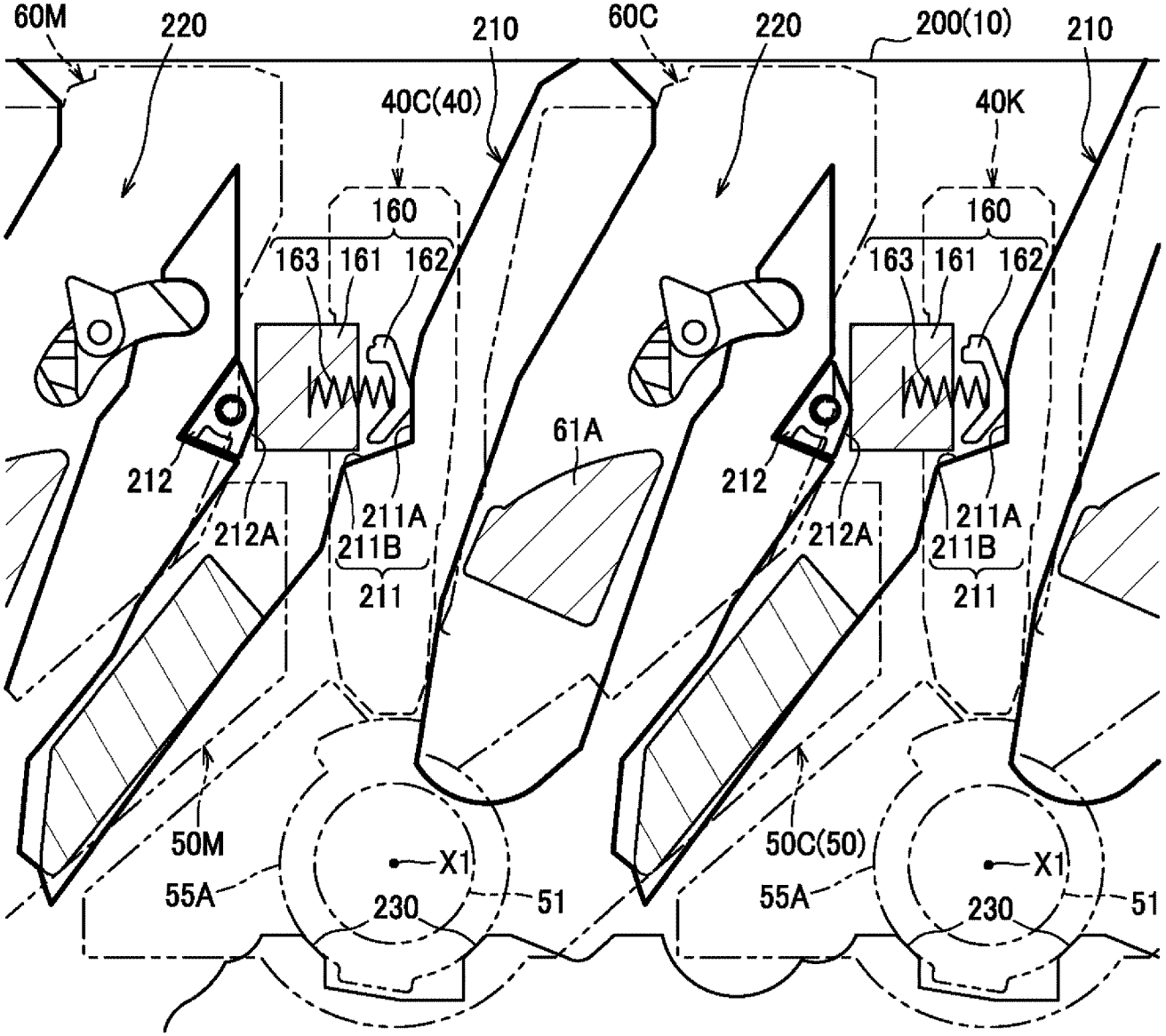
FIG. 8 is a partially enlarged view of FIG. 7.

As shown in FIG. 8, each of the grooves 210 and the groove 210B has a recess 211 provided at a rear side of each groove 210, 210B and a head locating surface 212A provided at a front side of each groove 210, 210B. The recess 211 is configured to allow at least part of the pressing member 160 to be received therein. The recess 211 comprises a contact surface 211A and an auxiliary guide surface 211B. The contact surface 211A is a surface extending vertically. The auxiliary guide surface 211B extends from a lower end of the contact surface 211A obliquely downward. When the exposure head 40 is located in the exposure position, part of the pressing part 162 of the pressing member 160 is received in the recess 211, and brought into contact with the contact surface 211A.

The head locating surface 212A is a portion with which the base 161 of the exposure head 40 in the exposure position comes in contact.

The housing 10 comprises members made of different materials, which include: a first member comprising a main portion of each groove 210, 210B; and a second member 212 comprising a portion of each groove 210, 210B which provides the head locating surface 212A at which the exposure head 40 is located in place. It is understood that the main portion of the groove 210, 210B in the first member is a portion other than the portion of the groove 210, 210B formed in the second member. In other words, the side frame 200 is made up of the first member for the most part, and only the portion which provides the head locating surface 212 inside the groove 210, 210B is made up of the second member 212. The second member 212 is made of a material higher in slipperiness than a material of the first member. The slipperiness herein relates to the friction produced against the base 161, i.e., the higher the slipperiness, the smaller the coefficient of friction is; thus, the coefficient of friction between the second member 212 and the base 161 is smaller than the coefficient of friction between the first member and the base 161.

The rotation axis X1 of the photoconductor drum 51 in the drum cartridge 50 installed in the housing 10 does not overlap the groove 210, 210C when viewed from a direction parallel to the rotation axis X1. Moreover, the photoconductor drum 51 in the drum cartridge 50 installed in the housing 10 does not overlap the groove 210, 210C when viewed from the direction parallel to the rotation axis X1. That is, when the drum cartridge 50 is installed in the housing 10, the photoconductor drum 51 in the drum cartridge 50 is placed in a position deeper than a lower edge of the groove 210, so that the groove 210 in itself does not serve to locate the photoconductor drum 51 in place; therefore, the photoconductor drum 51 is located in place, as described above, by contact of the arcuate portion 55A with the drum locating portions 230.

Referring back to FIG. 7, the housing 10 further comprises four grooves 220 in the side frame 200. Each of the protrusions 61A of four development cartridges 60 is configured to pass through a corresponding groove 220 when the process cartridge PC is installed into the housing 10 with the protrusion 55B of the drum cartridge 50 being guided through the groove 210 or 210C. The grooves 220 are arranged in the sub scanning direction. To be more specific, the grooves are formed separate from the grooves 210, 210B, 210C, and provided between the groove 210C and the rearmost groove 210, between the grooves 210, and between the frontmost groove 210 and the groove 210B.

The left side frame 201 of the housing 10 comprises a plurality of grooves having specific configurations and arrangements different from those of the grooves 210, 210B, 210C, 220 provided in the right side frame 200. Although a detailed explanation is not given herein, the left end portions of the drum cartridges 50 and the exposure heads 40 are guided and located in place with the configurations different from those of the right end portions of the drum cartridges 50 and the exposure heads 40.

Operation for installation of the process cartridge PC and the exposure head 40 into the housing 10 of the image forming apparatus 1 configured as described above will now be explained in detail.

Prior to installation into the housing 10, the process cartridge PC is prepared by attaching the development cartridge 60 to the drum cartridge 50 as shown in FIGS. 5A and 5B. The process cartridge PC is then installed from above through the opening 10A (see FIG. 2) into the housing 10 with the cover 11 opened as shown in FIG. 6. In this operation, the protrusion 55B of the drum cartridge 50 is inserted into one of the grooves 210 or the groove 210C. Accordingly, the general orientation of the process cartridge PC is regulated by the groove 210 or 210C while the process cartridge PC is installed into the housing 10. When the process cartridge PC is lowered to the limit, the arcuate portion 55A of the drum cartridge 50 comes in contact with a pair of drum locating portions 230 and gets stably supported by the pair of drum locating portions 230, with the result that the photoconductor drum 51 and its rotation axis X1 are located in place as specified. When the lower side surface of the protrusion 55B comes in contact with the frame locating surface 213, the position and orientation of the drum frame 55 are settled properly as specified. It is to be noted that when the drum cartridge 50 is in the installed drum position, the protrusion 61A of the development cartridge 60 is located adjacent to but not in contact with both sides of the groove 220. In other words, the groove 220 serves to provide a hollow space in the side frame 200 so that the protrusion 61A would not interfere with the side frame 200 when the drum cartridge 50 is in its installed drum position.

After all the process cartridges PC for respective colors have been installed in the housing 10, the cover 11 is operated. According as the cover 11 is swung down toward the closed position, the exposure heads 40 supported via the holders 12 on the cover 11 are lowered, and the pressing member 160 of each exposure head 40 is inserted into the corresponding groove 210 or 210B. Thus, the pressing member 160 passes through the groove 210 or 210B and moves downward. Once the cover 11 reaches the closed position and gets completely closed, as shown in FIG. 8, the base 161 of the pressing member 160 comes in contact with the head locating surface 212A of the second member 212, and the pressing part 162 comes in contact with the contact surface 211A. In this state, the pressing part 162 is biased by the spring 163 toward the contact surface 211A, and the base 161 is thus kept in contact firmly with the head locating surface 212A, so that the exposure head 40 is located in place in the sub scanning direction as specified.

As shown in FIG. 7, when the process cartridges PC for respective colors have been installed in the housing 10 and the cover 11 has been closed, the protrusion 55B of the drum cartridge 50K is received in the groove 210C so that the drum cartridge 50K is located in place. Meanwhile, the pressing member 160 of the exposure head 40K for black and the protrusion 55B of the drum cartridge 50C for cyan are received in one groove 210 so that the exposure head 40K and the drum cartridge 50C are located in place. Similarly, the pressing member 160 of the exposure head 40C for cyan and the protrusion 55B of the drum cartridge 50M for magenta are received in another one groove 210 so that the exposure head 40C and the drum cartridge 50M are located in place. Also, the pressing member 160 of the exposure head 40M for magenta and the protrusion 55B of the drum cartridge 50Y for yellow are received in still another one groove 210 so that the exposure head 40M and the drum cartridge 50Y are located in place. The pressing member 160 of the exposure head 40Y for yellow is received in the groove 210B so that the exposure head 40Y is located in place. In this way, the pressing members 160 of the exposure heads 40K, 40C, 40M are located in place by using the grooves 210 in which the protrusions 55B of the frontwardly adjacent drum cartridges 50C, 50M, 50Y are received, respectively.

Although not illustrated, each exposure head 40 is located in place in the axial direction (i.e., the main scanning direction) because the protuberance 161A (see FIG. 4) of the pressing member 160 is in contact with the bottom (surface facing in the axial direction) of the groove 210 or 210B.

When a process cartridge PC is removed from the housing 10, the procedural steps taken to install the process cartridge PC as described above may be reversed. First of all, the cover 11 is swung open, and the pressing members 160 of the exposure heads 40 move upward through the grooves 210 or the groove 210B accordingly, and eventually come out of the grooves 210 or the groove 210B. Thereafter, when the process cartridge PC is pulled up, the process cartridge PC moves upward and comes out of the housing 10 while the protrusion 55B is guided through the groove 210 or the groove 210C, and the protrusion 61A of the development cartridge 60 passes through the groove 220.

With the image forming apparatus 1 described above, the following advantageous effect may be achieved.

In the image forming apparatus 1, the groove 210 through which to guide installation of the drum cartridge 50 is also used to cause the exposure head 40 in its exposure position to be located in place in the sub scanning direction. Accordingly, the image forming apparatus 1 can be downsized in the sub scanning direction of the exposure head 40 in comparison with an alternative configuration in which a groove in which to cause an exposure head to be located in place in the sub scanning direction and another groove through which to guide installation of a drum cartridge are provided individually.

Since the pressing member 160 is configured to cause the exposure head 40 in its exposure position to be pressed in a direction parallel to the sub scanning direction, the exposure head 40 can be located in place accurately in the sub scanning direction.

Since the pressing member 160 is provided in the exposure head 40 and is thus kept clear of the way of installation of the drum cartridge 50 when the drum cartridge 50 is to be installed into the housing 10 through the groove 210, the installation of the drum cartridge 50 would not be obstructed by the pressing member 160 in the groove 210, and can be done smoothly without difficulty.

Since the second member 212 is made of a material higher in slipperiness than a material of the first member comprising the main portion of the groove 210, the exposure head 40 can be inserted smoothly up to the exposure position.

Since the protrusion 55B has a cross-sectional shape elongate in the direction of installation of the drum cartridge 50, the protrusion 55B can be smoothly guided through the groove 210 into which the protrusion 55B is inserted when the drum cartridge 50 is installed into the housing 10.

Since the drum cartridge 50 installed in the housing 10 is located in place by contact of the arcuate portion 55A with the housing 10 (drum locating portions 230), the rotation axis X1 of the photoconductor drum 51 can be accurately located in place relative to the housing 10.

Since the drum cartridge 50 installed in the housing 10 is located in place by contact of the protrusion 55B with the groove 210 or 210C, the orientation of the drum cartridge 50 about the rotation axis X1 can be controlled and settled properly by contact of the protrusion with the groove 210 or 210C.

The above-described embodiment may be implemented in various other forms as described below. In the following description, the same elements as those described above may be designated by the same reference characters, and a duplicate description thereof will be omitted.

Figure 9:
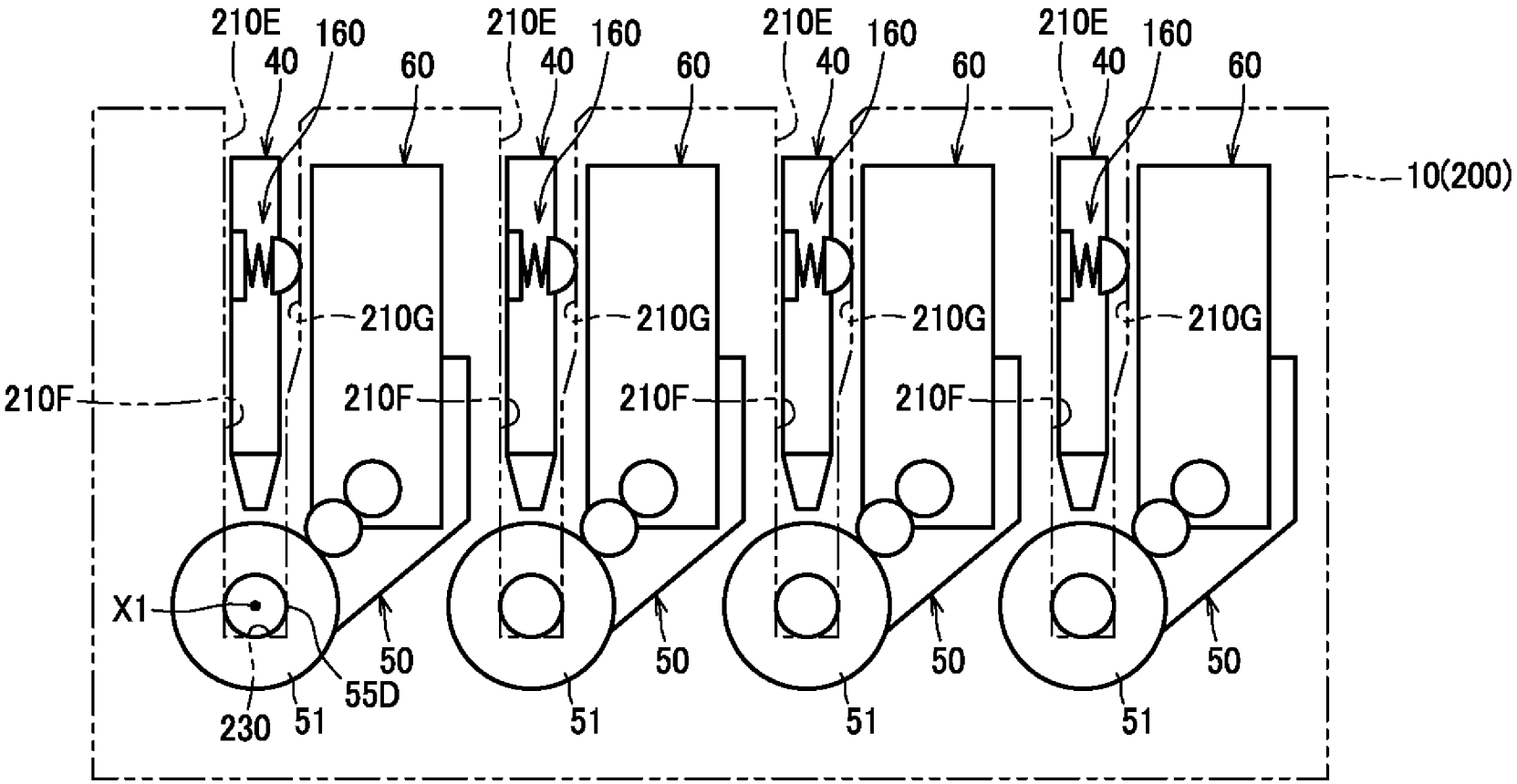
FIG. 9 is a diagram for explaining relative positions of grooves, process cartridges, and exposure heads, in a modified example.

In the image forming apparatus 1 described above, the groove 210 used for guiding the movement of and eventually locating the exposure head 40 for a specific color (e.g., magenta) is not used to guide the installation of the drum cartridge 50 for the same color (i.e., magenta), and the same groove 210 is commonly used to guide the installation of the adjacent drum cartridge 50 for a different color (e.g., yellow). This arrangement is not essential. In a feasible alternative as shown in FIG. 9, there are four grooves 210E provided in the housing 10 (side frame 200), and a groove 210E through which to guide installation of a drum cartridge 50 for a specific color may also serve as the groove in which an exposure head 40 for the same color is located in place in the sub scanning direction. To be more specific, each drum cartridge 50 may, as illustrated herein, comprise an arcuate portion 55D protruding outward beyond an end of the corresponding photoconductor drum 51 in a direction parallel to the rotation axis X1 and extending along a circumference of a circle of which a center coincides with the rotation axis X1. The arcuate portion 55D serves as a protrusion (like the above-described protrusion 55B) that is engageable in and slidable through the groove 210E to allow the drum cartridge 50 to be guided for installation in the housing 10. The arcuate portion 55D also serves as a portion like the arcuate portion 55A described above such that the drum cartridge 50 installed in the housing 10 is located in place by contact of the arcuate portion 55D with the drum locating portion 230 (provided in the groove 210E) of the housing 10. Each of the exposure heads 40 comprises a pressing member 160 configured to cause the corresponding exposure head 40 in its exposure position to be pressed in a direction parallel to the sub scanning direction. To be more specific, each groove 210E has a positioning surface 210F and a guide surface 210G. When the exposure head 40 is in the exposure position, the pressing member 160 presses the guide surface 210G to thereby cause the exposure head 40 to be pressed against the positioning surface 210F. With this alternative configuration, the arrangement and configuration of the grooves 210E in the housing 10 are simplified, so that a user can easily identify a target groove 210E in which the relevant drum cartridge 50 is to be inserted when the process cartridge PC is installed into the housing 10.

Although the recess 211 of the groove 210 or 210B illustrated above is configured to allow only the part of the pressing member 160 to be received therein, the recess may be configured to allow the whole pressing member 160 to be received therein.

The pressing member 160, though provided in the exposure head 40 in the above-described configurations, may be provided in the housing.

The image forming unit 4 consistent with this disclosure may not necessarily be a color printer as described above, but may be a monochrome image forming apparatus, instead. The image forming apparatus may be any apparatus, such as a copier, a multifunction machine, etc., other than the printer.

The elements described in the above embodiment and its modified examples may be implemented selectively and in combination.

What is claimed is:

1. An image forming apparatus comprising:

a housing;

one or more drum cartridges each of which includes a photoconductor drum and is installable in the housing; and one or more exposure heads each of which is configured to expose a corresponding photoconductor drum to light and to be movable between an exposure position fit to expose the corresponding photoconductor drum to light and a retreated position away from the corresponding photoconductor drum, wherein the housing comprises a groove through which to guide installation of a drum cartridge and in which to cause an exposure head in a corresponding exposure position to be located in place in a sub scanning direction, and wherein the image forming apparatus further comprises a pressing member configured to cause the exposure head in the corresponding exposure position to be pressed in a direction parallel to the sub scanning direction.

2. The image forming apparatus according to claim 1, wherein the pressing member is provided in the exposure head.

3. The image forming apparatus according to claim 2, wherein the groove comprises a recess configured to allow at least part of the pressing member to be received therein.

4. The image forming apparatus according to claim 1, wherein the housing comprises:

a first member comprising a main portion of the groove; and a second member comprising a portion of the groove which provides a surface at which the exposure head is located in place, wherein the second member is made of a material higher in slipperiness than a material of the first member.

5. The image forming apparatus according to claim 1, wherein each of the one or more drum cartridges comprises a drum frame by which the corresponding photoconductor drum is supported rotatably about a rotation axis of the corresponding photoconductor drum, wherein the drum frame comprises a protrusion protruding outward beyond an end of the corresponding photoconductor drum in a direction parallel to the rotation axis, the protrusion being configured to be engageable in and slidable through the groove to allow the drum cartridge to be guided for installation in the housing.

6. The image forming apparatus according to claim 5, wherein the rotation axis of the photoconductor drum in the drum cartridge installed in the housing does not overlap the groove when viewed from the direction parallel to the rotation axis.

7. The image forming apparatus according to claim 5, wherein the photoconductor drum in the drum cartridge installed in the housing does not overlap the groove when viewed from the direction parallel to the rotation axis.

8. The image forming apparatus according to claim 5, wherein the protrusion has a shape elongate in a direction of installation of the drum cartridge.

9. The image forming apparatus according to claim 5, wherein the drum frame further comprises an arcuate portion extending along a circumference of a circle of which a center coincides with the rotation axis, and wherein the drum cartridge installed in the housing is located in place by contact of the arcuate portion with the housing.

10. The image forming apparatus according to claim 5, wherein the drum cartridge installed in the housing is located in place by contact of a portion of the protrusion with the groove.

11. The image forming apparatus according to claim 1, wherein the one or more drum cartridges comprise a first drum cartridge including a first photoconductor drum, and a second drum cartridge including a second photoconductor drum, the first and second drum cartridges being arranged adjacent to each other in the sub scanning direction, wherein the one or more exposure heads comprise a first exposure head configured to expose the first photoconductor drum to light and to be movable between a first drum exposure position fit to expose the first photoconductor drum to light and a first retreated position away from the first photoconductor drum, and a second exposure head configured to expose the second photoconductor drum to light and to be movable between a second drum exposure position fit to expose the second photoconductor drum to light and a second retreated position away from the second photoconductor drum, wherein the housing comprises a first groove through which to guide installation of the first drum cartridge and a second groove through which to guide installation of the second drum cartridge, and wherein the second groove is used to cause the first exposure head in the first drum exposure position to be located in place in the sub scanning direction.

12. The image forming apparatus according to claim 1, wherein the groove through which to guide installation of the drum cartridge is used to cause an exposure head configured to expose a photoconductor drum included in the same drum cartridge to light to be located in place in the sub scanning direction.

13. The image forming apparatus according to claim 1, wherein the groove through which to guide installation of the drum cartridge is used to cause an exposure head configured to expose a photoconductor drum included in another drum cartridge to light to be located in place in the sub scanning direction.

14. An image forming apparatus comprising:

a housing comprising a groove;

a drum cartridge comprising a photoconductor drum; and an exposure head configured to emit light, the exposure head being movable between an exposure position fit to expose the photoconductor drum to light and a retreated position away from the exposure position;

wherein when the exposure head is in the exposure position, part of the exposure head is inserted in the groove, wherein when the drum cartridge is installed in the housing, the drum cartridge is guided through the groove, and wherein the image forming apparatus further comprises a pressing member configured to cause the exposure head in the exposure position to be pressed in a direction parallel to the sub scanning direction.

15. The image forming apparatus according to claim 14, wherein the groove has a positioning surface and a guide surface, wherein the exposure head comprises the pressing member, and wherein when the exposure head is in the exposure position, the pressing member presses the guide surface to thereby cause the exposure head to be pressed against the positioning surface.

16. The image forming apparatus according to claim 14, wherein the photoconductor drum is supported by the drum cartridge, rotatably about a rotation axis, wherein the drum cartridge comprises an arcuate portion protruding outward beyond an end of the photoconductor drum in a direction parallel to the rotation axis and extending along a circumference of a circle of which a center coincides with the rotation axis, and wherein when the drum cartridge is inserted in the housing, the arcuate portion is inserted in the groove.

17. An image forming apparatus comprising:

a housing;

one or more drum cartridges each of which includes a photoconductor drum and is installable in the housing; and one or more exposure heads each of which is configured to expose a corresponding photoconductor drum to light and to be movable between an exposure position fit to expose the corresponding photoconductor drum to light and a retreated position away from the corresponding photoconductor drum, wherein the housing comprises a groove through which to guide installation of a drum cartridge and in which to cause an exposure head in a corresponding exposure position to be located in place in a sub scanning direction, wherein each of the one or more drum cartridges comprises a drum frame by which the corresponding photoconductor drum is supported rotatably about a rotation axis of the corresponding photoconductor drum, wherein the drum frame comprises a protrusion protruding outward beyond an end of the corresponding photoconductor drum in a direction parallel to the rotation axis, the protrusion being configured to be engageable in and slidable through the groove to allow the drum cartridge to be guided for installation in the housing, and wherein the rotation axis of the photoconductor drum in the drum cartridge installed in the housing does not overlap the groove when viewed from the direction parallel to the rotation axis.

* * * * *